United States Patent [19]

Anderson

[11] 4,141,511

[45] Feb. 27, 1979

[54] MILL LINING ELEMENTS

[75] Inventor: Robert D. Anderson, Aurora, Colo.

[73] Assignee: Trelleborg Rubber Company, Inc., Solon, Ohio

[21] Appl. No.: 846,686

[22] Filed: Oct. 31, 1977

Related U.S. Application Data

[63] Continuation-in-part of Ser. No. 773,938, Mar. 3, 1977, abandoned.

[51] Int. Cl.[2] ..... B02C 17/22

[52] U.S. Cl. ..... 241/183; 241/299

[58] Field of Search ..... 241/181-183, 241/299, 300

[56] References Cited

U.S. PATENT DOCUMENTS

| | | | |
|---|---|---|---|
| 2,611,546 | 9/1952 | Posselt | 241/183 |
| 3,378,209 | 4/1968 | Crocheron | 241/182 X |
| 3,680,799 | 8/1972 | Hallerback | 241/183 |
| 3,934,828 | 1/1976 | Persson | 241/300 X |

FOREIGN PATENT DOCUMENTS

| | | | |
|---|---|---|---|
| 680012 | 2/1964 | Canada | 241/183 |
| 1810920 | 7/1969 | Fed. Rep. of Germany | 241/183 |

*Primary Examiner*—Howard N. Goldberg
*Attorney, Agent, or Firm*—Meyer, Tilberry & Body

[57] ABSTRACT

A mill lining element is disclosed comprising a body of rubber having top and bottom surfaces and longitudinal side edges which extend in the direction of the axis of a mill shell. The body is reinforced by means of a metal plate covering the bottom surface and longitudinally extending metal bars attached to the metal plate adjacent the side edges thereof and extending through the body toward the top surface thereof.

20 Claims, 5 Drawing Figures

MILL LINING ELEMENTS

This application is a continuation-in-part of copending application Ser. No. 773,938 filed Mar. 3, 1977 and now abandoned.

The present invention relates to the art of abrasive material treating or handling and, more particularly, to improved lining elements for a rotary mill drum or the like.

Rotary mills are well known apparatus used, for example, in mixing and/or pulverizing various types of materials. Such mills commonly include a metal shell or drum which is cylindrical in cross section and which is supported for rotation about the longitudinal axis thereof. Metal balls, or the like, are placed in the drum together with the material to be treated, and rotation of the drum results in the desired grinding or mixing of the material. In order to protect the metal shell or drum of a mill from the effects of abrasive and/or impact contact of material therewith, the drum is provided with a protective wear resistant lining of an elastomeric material such as natural or synthetic rubber. Such linings are generally defined by a plurality of elements in the form of strips or segments of lining material assembled within the drum to cover the inner surface thereof. Often, circumferentially adjacent ones of the strips are clamped against the mill surface by means of hold down bars which engage the opposed longitudinally extending side edges of adjacent strips and are bolted or otherwise attached to the mill drum to hold the liner strips in place.

In connection with mill linings of the foregoing character, problems are encountered with respect to maintaining the lining strips against unintended separation from the hold down bars during mill operation and which separation of course exposes the underlying wall portion of the mill to the material being treated. Such separation of an element from its clamped position relative to the mill wall can occur as the result of the impact of material or balls in the mill therewith. Separation can also occur as a result of flexure of the lining strip radially inwardly of the mill either as a result of the radial clamping force on the side edges of the strip and/or the weight of the liner material in the unclamped areas thereof which is directed radially inwardly of the mill when the liner strip is moving above a horizontal plane through the mill during rotation thereof. More particularly, the radial clamping pressure along the longitudinal side edges of the liner strip tends to squeeze the side edges radially thus imposing forces on the strip material in the circumferential areas between the side edges tending to promote buckling of the material radially inwardly of the drum. This buckling tendency is then further promoted by the impact or bouncing of material in the drum against the liner strip and, eventually, one or both side edges of the strip becomes disengaged from under the hold down bar. Such buckling is also further promoted by the weight of the lining material when, as mentioned above, the strip is disposed above a horizontal plane through the mill.

Additionally, it is extremely difficult to achieve uniform clamping pressure along a given side edge of a liner strip and this too adds to the retention problem. Thus, if the pressure is sufficient along one portion of the edge for retention and insufficient along another portion, the latter portion can promote separation of the entire edge with respect to the hold down bar. Still further, if too much clamping pressure is applied the liner material can rupture along the edge which is clamped and possibly be separated therefrom, thus producing the same effect as that produced by separation of the edge from beneath the hold down bar. Adequate contact between the hold down bars and liner strips can also be gradually lost through erosion of the material resulting from frictional engagement therebetween. These problems are especially pronounced in connection with large diameter drums in that it is desired in such drums to minimize the number of lining strips required circumferentially so as to reduce construction and maintenance costs which are of course dependent in part on the number of strips which have to be installed. Therefore, if the circumferential dimensions of the strip elements have to be reduced to minimize or avoid the separation problems, more strips have to be used and more time is required to initially install and subsequently replace worn or damaged strips.

In accordance with the present invention, lining elements or strip structures are provided which advantageously avoid the separation problems heretofore encountered and enables the use of dimensionally larger liner elements than could be employed heretofore in connection with a given size drum. In this respect, a liner element in accordance with the present invention is provided with a reinforcing structure along the longitudinal side edges thereof which rigidifies the side edges against lateral and radial flexure, limits radial compression of the side edges, and provides for the effective clamping pressure to be substantially uniform throughout the longitudinal extent of the side edges. More particularly, in accordance with the present invention, the body of a liner element is reinforced longitudinally at least along the side edges thereof and preferably laterally between the side edges to restrain lateral and radial flexure of the element. Additionally, the liner element is reinforced radially along each side thereof in a manner which effectively defines a fixed radial dimension along each edge of the element and restrains radial and lateral flexure of the side edges thereof. Preferably, restraint against lateral and radial flexure is achieved by means of a metal plate attached to the liner body so as to be parallel to the mill drum wall, and metal members attached to the plate and extending radially therefrom a given dimension into the liner material. The fixed radial dimension of the plate and metal members facilitates obtaining a uniform clamping pressure along the edges of the liner element by limiting radial compression of the body material along the edges.

It is an object of the present invention to provide an improved mill lining element of the character having side edges by which the element is adapted to be clamped in place with respect to the inner surface of a mill drum.

Another object is the provision of a mill lining element of the foregoing character having reinforced side edges to improve retention capabilities thereof with respect to a mill wall and hold down bars by which the strip is attached to the wall.

A further object is the provision of a liner element of the foregoing character in which the longitudinally extending side edges of the element are stabilized against the lateral and radial flexure when the element is clamped in place with respect to a mill drum wall.

Still another object is the provision of a liner element of the foregoing character in which the longitudinal side edges are provided with reinforcement extending radially of the element to limit radial compression of the side edge and to promote uniformity of radial clamping pressure along the side edge.

Yet another object is the provision of an improved mill lining element which enables the use of optimum dimensions for the element with respect to a given drum size thus to minimize the number of elements required to provide a complete lining and to accordingly reduce installation and maintenance time with regard to a lining assembly.

Still a further object is the provision of a lining element of the foregoing character which is economical to produce, install and maintain and which provides for increasing the efficiency of mill operation by minimizing down time for maintenace and replacement purposes.

The foregoing objects and others will in part be obvious and in part pointed out more fully hereinafter in conjunction with the written description of a preferred embodiment of the invention illustrated in the accompanying drawings in which.

Figure 1:
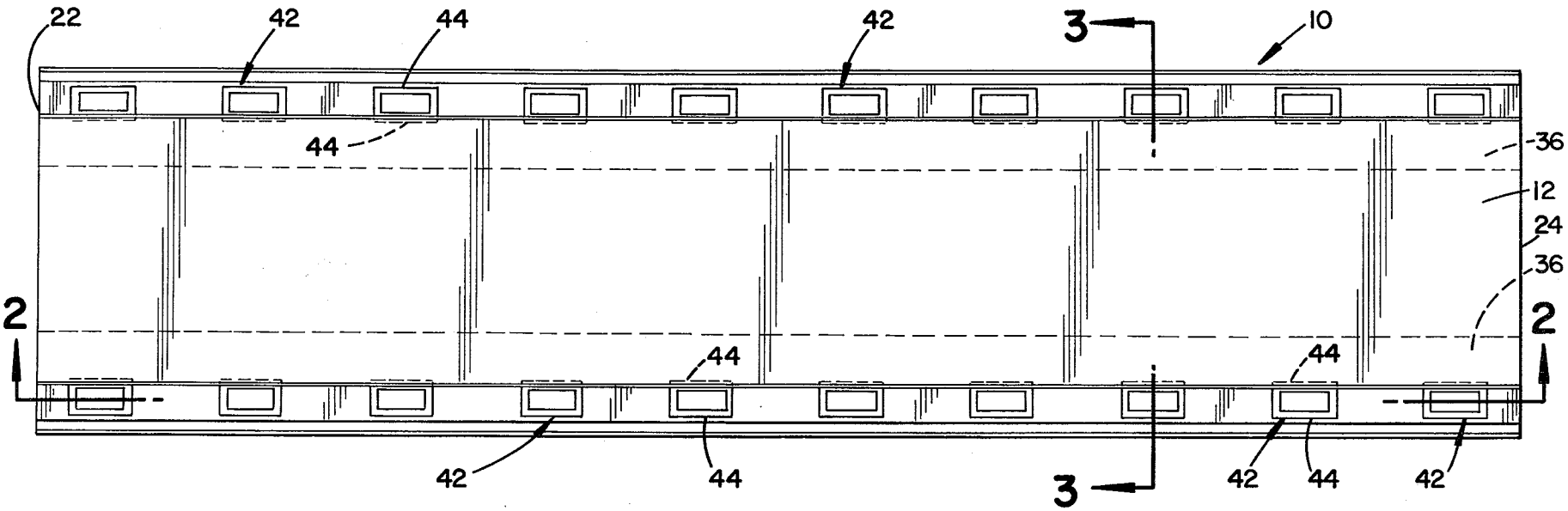
FIG. 1 is a plan view of a mill liner element made in accordance with the present invention.
Figure 2:
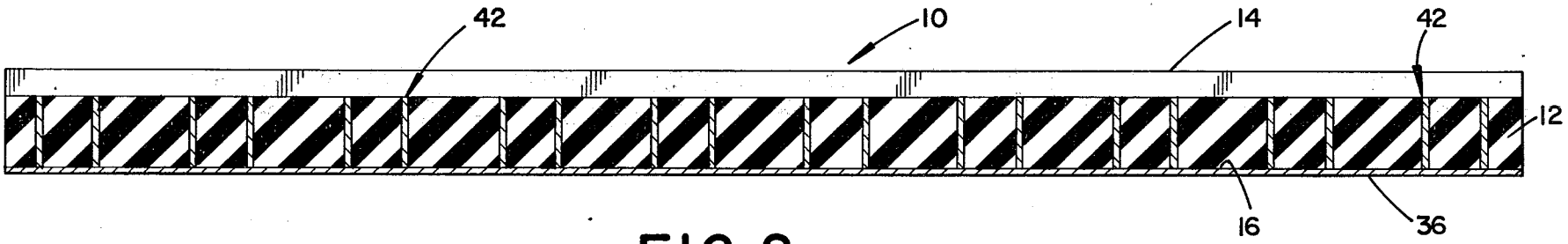
FIG. 2 is a sectional side elevation view of the liner element taken along line 2—2 in FIG. 1.
Figure 3:
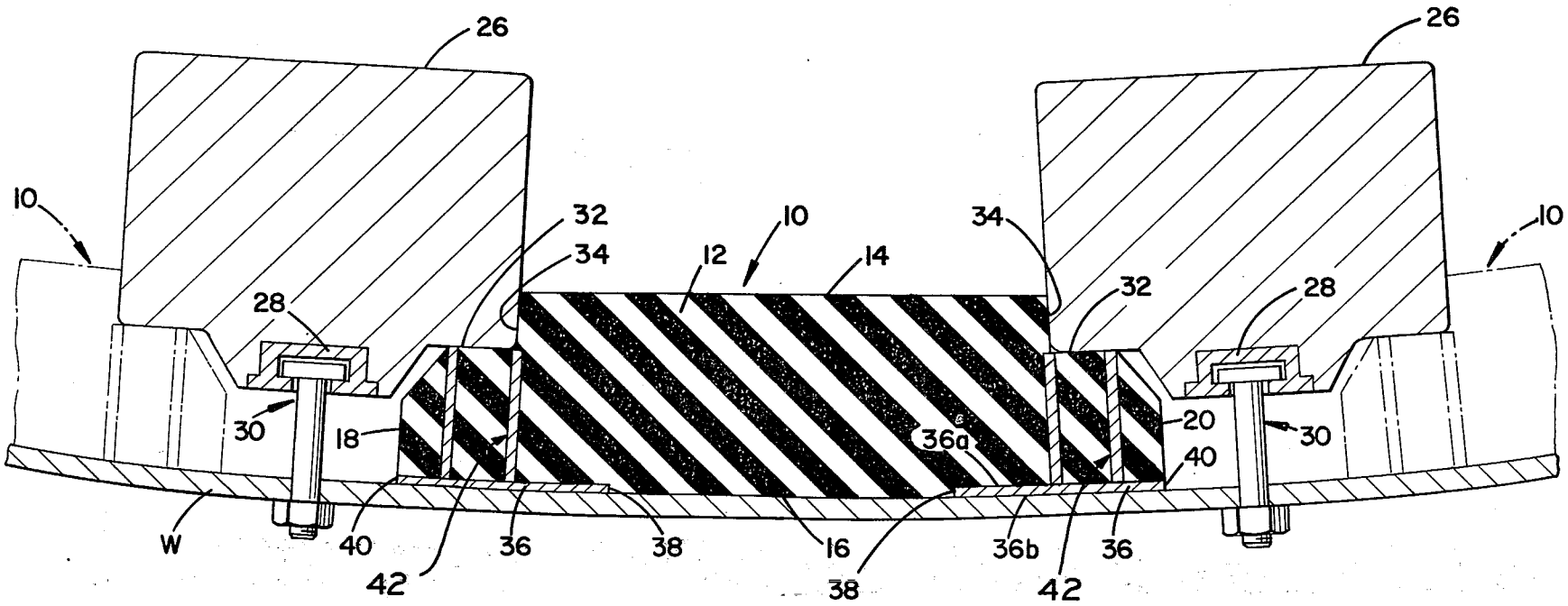
FIG. 3 is a sectional end elevation view of the liner element taken along line 3—3 in FIG. 1, and showing the element in association with a mill drum wall and hold down bars.

Referring now in greater detail to the drawings wherein the showings are for the purpose of illustrating preferred embodiments of the invention only and not for the purpose of limiting the invention, a liner element 10 is shown in FIGS. 1–3 which includes a body 12 of wear resistant resilient material such as natural or synthetic rubber. Body 12 includes a top surface 14, a bottom surface 16, opposite parallel longitudinally extending sides 18 and 20, and opposite ends 22 and 24. In accordance with the present invention, each of the longitudinally extending sides of body 12 is reinforced as described hereinafter to stabilize the liner component against flexure during use and to avoid excessive wear and/or rupturing of the material of the liner element adjacent the sides thereof as a result of radial and frictional forces applied thereto by lifter bars 26 by which circumferentially adjacent elements are radially clamped against the inner surface of a mill drum wall W, as seen in FIG. 3. It will be appreciated of course that a number of lining elements 10 are mounted within a mill drum in side-by-side relationship to circumferentially cover the inner surface of the drum. Lifter bars 26 are longitudinally coextensive with the liner elements and are suitably attached to the mill wall W. For example, the lifter bars can be provided with extruded key slot bars 28 which receive the head of a bolt 30 by which the lifter bar is attached to the mill wall.

Top surface 14 of body 12 of liner element 10 is contoured along the length of each side 18 and 20 to provide corresponding longitudinally extending recesses each defined by walls 32 and 34. Each wall 32 provides a clamping force receiving surface along the corresponding side of the liner element, and each wall 34 provides an abutment surface along the corresponding side to restrain circumferential displacement of the liner element relative to the mill wall and lifter bar.

In the embodiment shown in FIGS. 1–3, reinforcement for each side of body 12 is provided by a metal member 36 which is longitudinally coextensive with body 12. Preferably, member 36 is a metal plate having top and bottom surfaces **36*a* and 36*b*, respectively, bottom face 36*b* being coplanar with bottom surface 16 of body 12. Further, each plate 36 has longitudinally extending parallel inner and outer edges 38 and 40, respectively, and outer edges 40 preferably are contiguous with the plane of the corresponding one of the sides 18 and 20 of body 12. The edge reinforcement further includes a plurality of metal members or posts 42 spaced apart along the length of each plate 36 and having lower ends suitably attached to the corresponding plate such as by welding. Further, members 42 extend radially inwardly with respect to drum wall W and have upper ends terminating at wall 32 of the corresponding recess in body 12. Preferably, posts 42 are steel tubes perpendicular to plate 36 and rectangular in cross section. The tubes are dimensioned and oriented relative to plate 36 for the long sides 44 of the tubes to be parallel to and spaced inwardly from side edges 38 and 40 of plate 36. Preferably, body 12 of the liner is molded and plates 36 and the corresponding tubes 42 are preassembled and joined with body 12 during molding of the latter so that tubes 42** are embedded in the body material and the interiors of the tubes are filled with the body material.

Tubes 42 are of the same length or height relative to plate 36 and, as seen in FIG. 3, the tubes receive the radial clamping force applied by lifter bars 26 and transmit the clamping force directly to the corresponding plate 36. Thus, plates 36 and tubes 42 establish a fixed radial dimension for the sides of the liner element and restrain radial compression of the body material along the sides. Moreover, through the radial rigidity against compression a workman can, by feel, tighten the several hold down bar bolts 30 for each to apply substantially the same holding force, thus providing a substantially uniform clamping pressure along the sides of the liner element. Additionally, plates 36 and the corresponding tubes 42 stabilize the sides of body 12 of the liner element against flexure laterally and longitudinally. All of these reinforcement characteristics lend to increasing the life of the liner element and retention of the element on the mill drum wall. In this respect, the reinforcement structures serve to restrain frictional wear engagement of the side edges of the liner element with the lifter bars, to restrain tearing of the material of body 12 as a result of radial compression of the side edges and flexure thereof relative to the lifter bars and mill wall, and to restrain flexure of the liner element which promotes displacement of the side edges of the liner element from captive engagement between the mill wall and lifter bars.

It will be appreciated that the specific dimensions of the body and reinforcing members for a liner element of the character herein described will vary depending on the size and dimensions of the surface to be lined and the abrasive and impacting characteristics of the material from which the lined surface is to be protected. The lining element illustrated in FIGS. 1–3 and described above is for use in connection with a ball mill having a shell diameter of about 15′ and a length of about 27′. The body 12 of each liner element is rubber and has a length between ends 22 and 24 of about 59″ and a width between sides 18 and 20 of about 14½. Further, body 12 has a thickness between top and bottom surfaces 14 and 16 in the area laterally between the recesses of about 4″.

Recess walls 34 have a vertical height of about 1¼", and recess walls 32 have a horizontal width of about 1¼". Plates 36 are steel plates 3/16" thick and having a width of 4" between inner and outer edges 38 and 40, and tubes 42 are steel tubes 1½" wide by 2½" long in cross section and having a height of 2-9/16" and a wall thickness of 174 ". The tube axes are spaced apart 6".

While flat metal plates and rectangular metal tubes perpendicular thereto and spaced inwardly of the side edges of the plates are shown in this embodiment, it will be appreciated that the desired reinforcing can be achieved with other structural arrangements without departing from the principles of the present invention. In this respect, for example, the metal members 42 can be solid rather than hollow and, whether solid or hollow can be of a cross sectional configuration other than rectangular. The hollow tube is more economical and the rectangular configuration provides the best profile for molding the reinforced liner element.

Figure 4:
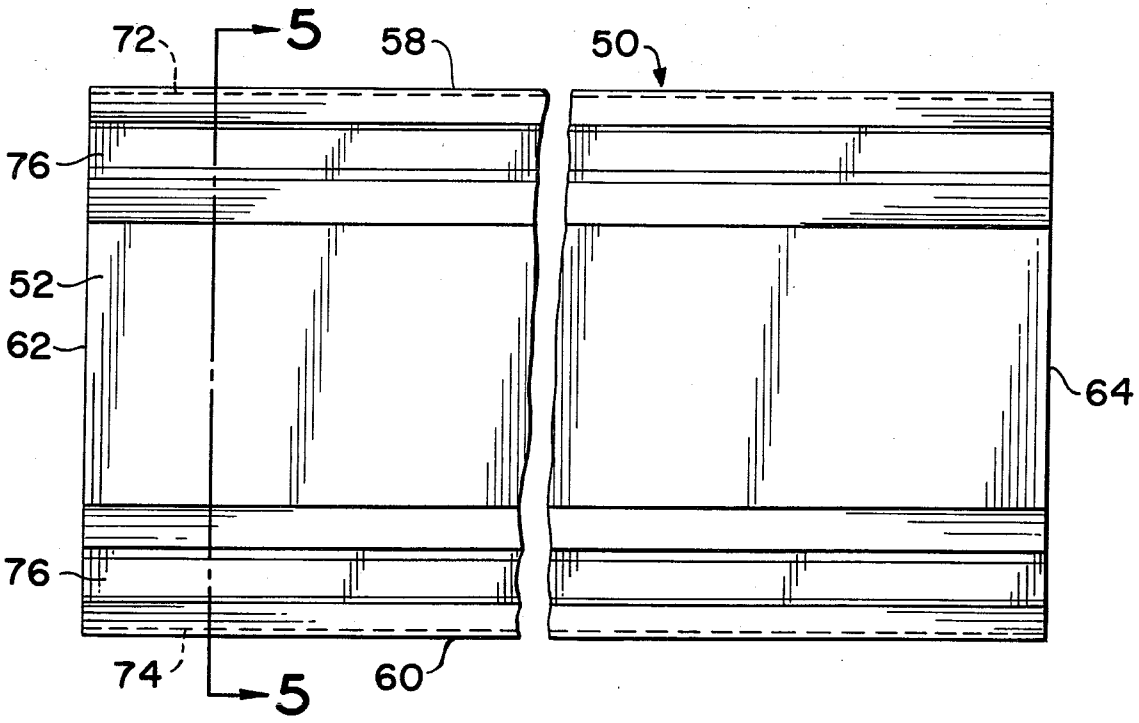
FIG. 4 is a plan view of another mill liner made in accordance with the present invention; and, FIG. 5 is a sectional and elevation view of the liner in FIG. 4 taken along line 5—5 in FIG. 4.
Figure 5:
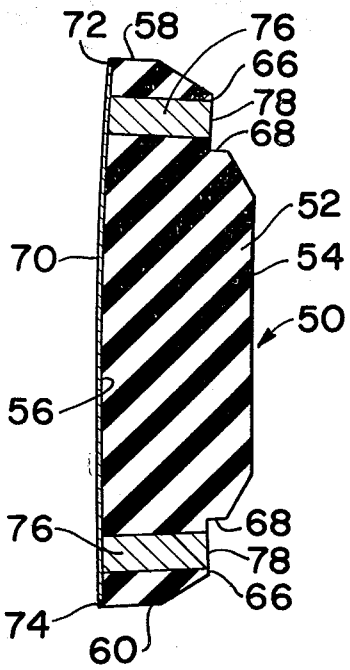

FIGS. 4 and 5 of the drawings illustrate another embodiment of a liner element made in accordance with the present invention. The liner element 50 shown in FIGS. 4 and 5 is similar in certain respects to the element shown in FIGS. 1–3 and, in this respect, includes a body 52 of wear resistant resilient material having a top surface 54, a bottom surface 56, opposite parallel longitudinally extending sides 58 and 60 and opposite ends 62 and 64. Further, top surface 54 of body 52 is contoured along the length of each side 58 and 60 to provide corresponding longitudinally extending recesses each defined by walls 66 and 68. As in the embodiment shown in FIGS. 1–3, each wall 66 provides a clamping force receiving surface along the corresponding side of the liner element, and each wall 68 provides an abutment surface along the corresponding side to restrain circumferential displacement of the liner element when the latter is mounted on a mill wall by lifter bars in the manner shown in FIG. 3.

In the embodiment shown in FIGS. 4 and 5, the reinforcement for each longitudinal side of body 52 includes a single metal plate member 70 covering bottom surface 56 of the body and having longitudinally extending parallel outer side edges 72 and 74 adjacent the corresponding one of the sides 58 and 60 of body 52. The edge reinforcement further includes a pair of metal bars 76 longitudinally coextensive with plate 70 and having lower ends suitably attached to plate 70 such as by welding. Preferably, bars 76 are rectangular in cross section, are spaced laterally inwardly from the corresponding side edge of plate 70 to underlie the corresponding recess wall 66 of body 52 and have outer ends 78 terminating at the corresponding wall 66. Preferably, plate 70 and bars 76 are preassembled and body 52 of the liner is molded thereabout, whereby the bars are embedded in the body material and the body material is bonded thereto and to plate 70.

Bars 76 are of the same height with respect to plate 70, whereby the bars receive the radial clamping force applied by the lifter bars when the liner is mounted in the manner shown in FIG. 3 and transmit the clamping force directly to the plate 70. Accordingly, plate 70 and bars 76 establish a fixed radial dimension for the sides of the liner element and restrain radial compression of the body material along the sides. Moreover, as in the embodiment shown in FIGS. 1–3, the radial rigidity thus provided against compression enables mounting of the liner element on a mill wall with a substantially uniform clamping pressure along the sides of the element. Still further, plate 70 and bars 76 stabilize the sides of body 52 against flexure laterally and longitudinally to restrain frictional wear between the liner element and lifter bars, to restrain tearing of the material of body 52 as a result of radial compression and flexure thereof relative to the lifter bars and mill wall, and to restrain flexure of the liner element which promotes displacement of the side edges of the liner element from captive engagement between the mill wall and lifter bars. Additionally, the single plate and solid bar structure rigidifies the sides of the liner element against distortion of the metal plate as the result of clamping pressure when the liner is mounted on a mill wall. In this respect, clamping pressure applied on the liner element structure shown in FIGS. 1–3 together with the forces applied on the liner during use by material impact thereagainst and the like can cause the individual metal plates and corresponding portions of the body material to twist longitudinally upon removal of the lifter bars such as for replacement thereof. While this twisting does not adversely effect the reinforcement or retention characteristics of the liner element and does not occur until the lifter bar is removed from the mill drum, such distortion of the liner element does add difficulty to the task of mounting a new lifter bar in the mill drum. Such twisting is advantageously restrained by the single plate and solid bar construction shown in FIGS. 4 and 5, whereby the latter structure is preferable for those situations where the mill lining is likely to be subjected to conditions of use which would promote distortion of the character mentioned above.

The lining element illustrated in FIGS. 4 and 5 and described above is for use in connection with a ball mill having a shell diameter of about 15' and the length of about 27'. The body 52 of the liner element is rubber and has a length between ends 62 and 64 of about 36" and a width between sides 58 and 60 of about 14½". Further, the liner has a thickness between top surface 54 and the bottom surface of plate 70 of about 4", and plate 70 is a steel plate 3/16" thick and substantially laterally and longitudinally coextensive with body 52. Bars 76 are steel and are longitudinally coextensive with plate 70 and body 52. Further, the bars have a lateral width of about 1" and a height from plate 70 of about 2½". Each bar 76 is spaced inwardly from the corresponding side edge of plate 70 about 1".

It will be appreciated from the foregoing descriptions of the embodiments herein illustrated that the individual plates 36 in FIGS. 1–3 could be replaced by a single plate such as shown in the embodiment of FIGS. 4 and 5, and that solid metal bars such as bars 76 shown in FIGS. 4 and 5 could be employed with the individual plates 36 of the embodiment shown in FIGS. 1–3 in place of the individual tubes 42. Moreover, while plates 36 and 70 in the embodiments shown are preferably laterally and longitudinally flat, it will be appreciated that the plates can have other cross-sectional configurations. It is only necessary in accordance with the present invention that the plates restrain lateral flexure of the liner element sides, and that the plates, tubes, bars, or other projection configurations, cooperatively provide a fixed radial dimension along the sides of the element to limit radial compression. Thus, plates 36 and 70 could be intermediate the top and bottom surfaces of the body material of the liner elements and the tubes or bars could project from opposite sides of the plates to the corresponding body surface. Moreover, in connection with engagement of the sides of the liner elements between the mill wall and hold down bars, it will be understood that a thin layer of the material of the body of the liner elements can be interposed between these components and the reinforcing elements. In the embodiments shown, for example, thin layers of rubber can overlie the bottom faces of plates 36 and 70 and the top edges of tubes 42 and bars 76. Such a layer of the body material often results from the molding process and, while it can be removed, does not effect the functioning of the reinforcement structure in the intended manner and, accordingly, does not have to be removed. Thus, it will be appreciated in accordance with the present invention that it is only necessary for the reinforcing structure to restrain undesirable radial compression of the side edges of the liner element and that this can be achieved without having direct engagement between the plate and mill wall and between the tubes or bars and the hold down bar. Still further, while it is preferred to provide recesses along the sides of the liner elements to receive hold down bars as herein shown and described, it will be appreciated that the liner elements can be of uniform radial thickness throughout the lateral width thereof.

The foregoing modifications, as well as other embodiments and modifications, will be suggested or apparent upon reading and understanding the description herein of the preferred embodiments. Accordingly, it is to be distinctly understood that the foregoing descriptive matter is to be interpreted merely as illustrative of the present invention and not as a limitation.

Having thus described the invention it is claimed:

1. A rotary mill lining element comprising a body of wear resistant resilient material having top and bottom surfaces and opposite sides and ends, and reinforcing means extending along and laterally adjacent each said sides of said body said reinforcing means including metal member means longitudinally coextensive with said body between said ends thereof, said reinforcing means further including projection means attached to said metal member means along and laterally adjacent each said sides of said body and extending from said metal member means into the material of said body in the direction between said top and bottom surfaces, and said metal member means and projection means extending from said top surface to said bottom surface of said body to provide a fixed dimension in said direction for said lining element along each said sides of said body.

2. The lining element according to claim 1, wherein said metal member means is plate means having opposite faces generally parallel to said bottom surface of said body.

3. The lining element according to claim 2, wherein said projection means is perpendicular with respect to said faces of said plate means.

4. The lining element according to claim 3, wherein said projection means is a metal bar.

5. The lining element according to claim 4, wherein said plate means is a single metal plate extending laterally between said sides of said body.

6. The lining element acording to claim 5, wherein said metal plate is on said bottom surface of said body.

7. The lining element according to claim 3, wherein said projection means is a plurality of posts.

8. The lining element according to claim 7, wherein said plate means is a pair of laterally spaced apart metal plates each extending along and laterally adjacent one of said sides of said body.

9. The lining element according to claim 8, wherein said posts are hollow metal tubes.

10. The lining element according to claim 9, wherein said metal plates are generally coplanar with said bottom surface of said body.

11. A rotary mill lining element comprising, a body of wear resistant resilient material having top and bottom surfaces and opposite sides and ends, a pair of laterally spaced apart metal plates extending along said bottom surface between said opposite ends and each adjacent one of said opposite sides of said body, and a plurality of posts on each of said plates spaced apart in the direction between said opposite ends of said body and extending from the corresponding plate into said body toward said top surface, said posts having outer ends intersecting said top surface of said body.

12. The lining element according to claim 11, wherein said posts are hollow metal tubes.

13. The lining element according to claim 12, wherein said tubes are rectangular in cross section.

14. A rotary mill lining element comprising, a body of wear resistant resilient material having top and bottom surfaces and opposite sides and ends, a pair of laterally spaced apart metal plates extending along said bottom surface between said opposite ends and each adjacent one of said opposite sides of said body, and a plurality of posts on each of said plates spaced apart in the direction between said opposite ends of said body and extending from the corresponding plate into said body toward said top surface, said plates having outer and inner side edges, said outer side edges being contiguous with the corresponding side of said body, said posts having a lateral dimension less than the distance between said side edges and being laterally spaced from the inner and outer side edges of the corresponding plate.

15. The lining element according to claim 14, wherein said posts are metal tubes perpendicular to the corresponding plate and having outer ends intersecting said top surface of said body.

16. The lining element according to claim 15, wherein said tubes are rectangular in cross section and oriented for the longer sides thereof to be parallel to the inner and outer side edges of the corresponding plate.

17. A rotary mill lining element comprising, a body of wear resistant resilient material having top and bottom surfaces and opposite sides and ends, a metal plate extending along said bottom surface of said body and laterally and longitudinally coextensive therewith, said metal plate having longitudinally extending side edges, and a metal bar member attached to said metal plate adjacent each of said side edges of said plate, each of said metal bars being longitudinally coextensive with said metal plate and extending from said plate into said body toward said top surface of said body, said bars having outer ends intersecting said top surface of said body.

18. The lining element according to claim 17, wherein said bars are rectangular in transverse cross section, the longer sides thereof extending in the direction from said metal plate toward said top surface of the body.

19. The lining element according to claim 17, wherein said metal bars are each spaced laterally inwardly from the corresponding side edge of said metal plate.

20. The lining element according to claim 19, wherein said bars are rectangular in transverse cross section, the longer sides thereof extending in the direction from said metal plate toward said top surface of the body.

* * * * *